US006192975B1

(12) United States Patent
Yanai et al.

(10) Patent No.: US 6,192,975 B1
(45) Date of Patent: Feb. 27, 2001

(54) HEAT EXCHANGER

(75) Inventors: Hideyuki Yanai; Tadashi Tsunoda; Tsuneo Endou; Tokiyuki Wakayama, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/284,461

(22) PCT Filed: Oct. 17, 1997

(86) PCT No.: PCT/JP97/03781

§ 371 Date: Jun. 15, 1999

§ 102(e) Date: Jun. 15, 1999

(87) PCT Pub. No.: WO98/16789

PCT Pub. Date: Apr. 23, 1998

(30) Foreign Application Priority Data

Oct. 17, 1996 (JP) ..... 8-275053
Oct. 17, 1996 (JP) ..... 8-275055
Oct. 17, 1996 (JP) ..... 8-275056

(51) Int. Cl.[7] ..... F28D 1/02; F28F 13/00; F28F 3/00

(52) U.S. Cl. ..... 165/165; 165/166; 165/153; 165/146

(58) Field of Search ..... 165/165, 166, 165/153, 146, DIG. 399

(56) References Cited

U.S. PATENT DOCUMENTS 2,828,946 * 4/1958 Smith ..... 165/165
2,941,787 * 6/1960 Ramen ..... 165/166
2,945,680 * 7/1960 Slemmons ..... 165/DIG. 399
3,291,206 * 12/1966 Nicholson ..... 165/166
3,759,323 * 9/1973 Dawson et al. ..... 165/166
3,877,517 * 4/1975 Pasternak ..... 165/146
4,043,388 * 8/1977 Zebuhr ..... 165/166
4,314,607 * 2/1982 DesChamps ..... 165/166
4,343,355 * 8/1982 Goloff et al. ..... 165/DIG. 399
4,384,611 * 5/1983 Fung ..... 165/DIG. 399

FOREIGN PATENT DOCUMENTS 0 177 904 4/1986 (EP) .
48-44530 12/1973 (JP) .
49-49238 5/1974 (JP) .
57-2983 1/1982 (JP) .
57-500945 5/1982 (JP) .
58-223401 12/1983 (JP) .
61-153500 7/1986 (JP) .
WO97/06395 2/1997 (WO) .
WO98/33030 7/1998 (WO) .

* cited by examiner

*Primary Examiner*—Ira S. Lazarus
*Assistant Examiner*—Tho Duong
(74) *Attorney, Agent, or Firm*—Arent Fox Kintner Plotkin & Kahn

(57) ABSTRACT

First heat-transfer plates S1 and second heat-transfer plates S2 are radially arranged between a larger diameter cylindrical-shaped outer casing 6 and a smaller diameter cylindrical-shaped inner casing 7 to form combustion gas passages 4 and air passages 5 alternately in a circumferential direction, and a multiplicity of projections 22, 23 formed on both surfaces of the first heat-transfer plates S1 and second heat-transfer plates S2 are jointed to one another at tip ends thereof. Pitches P between adjacent projections 22, 23 are changed in a radial direction to make the number of heat transfer units substantially constant in a radial direction to uniformize temperature distributions on the first heat-transfer plates S1 and second heat-transfer plates S2 in the radial direction, thereby avoiding a decrease in heat exchanging efficiency and generation of unwanted thermal stress.

8 Claims, 15 Drawing Sheets

HEAT EXCHANGER

FIELD OF THE INVENTION

The present invention relates to a heat exchanger including high-temperature fluid passages and low-temperature fluid passages defined alternately by folding a plurality of first heat-transfer plates and a plurality of second heat-transfer plates in a zigzag fashion.

BACKGROUND ART

A heat exchanger is already known from Japanese Patent Application Laid-open No. 61-153500, which includes a large number of projections which are formed on heat-transfer plates defining high-temperature fluid passages and low-temperature fluid passages, and which are coupled together at tip ends of the projections.

In a heat exchanger including first and second heat-transfer plates disposed radiately to define the high-temperature fluid passages and the low-temperature fluid passages alternately in a circumferential direction, the sectional area of a flow path in each of the high-temperature fluid passages and the low-temperature fluid passages is narrower on its radially inner side and wider on a radially outer side, and the level of the projections formed on the heat-transfer plate is lower on the radially inner side and higher on the radially outer side. As a result, there is a possibility that the heat transmission coefficient of the heat-transfer plate and the mass flow rate of the fluid may be non-uniform radially, whereby the total heat-exchange efficiency is reduced, and an undesirable thermal stress is produced.

There is also a conventionally known heat exchanger which is described in Japanese Patent Application Laid-open No. 58-223401, which includes a plurality of heat-transfer plates disposed at a predetermined distance, and high-temperature fluid passages and low-temperature fluid passages defined between adjacent heat-transfer plates by bonding tip ends of bank-shaped projection stripes formed on the heat-transfer plates to each other.

When the tip ends of the projection stripes formed at end edges of the adjacent heat-transfer plates are bonded to each other by brazing, the end edges of the heat-transfer plates may be curved in a direction opposite from a direction of protrusion of the projection stripes due to a thermal influence of the brazing, whereby the sectional area of a flow path in each of an inlet and an outlet of the fluid passage defined between the adjacent heat-transfer plates may be reduced in some cases. Moreover, if the projection stripes are disposed on folding lines for folding the first and second heat-transfer plates in a zigzag fashion, the rigidity of those portions of the first and second heat-transfer plates which correspond to the projection stripes is increased, whereby it is difficult to carry out the folding operation. Moreover, the shape of a folded area at each of the folding lines may be destroyed at such portions to produce a gap between the projection stripes, whereby the fluid may be leaked from such gap in some cases, resulting in a reduction in a heat transfer efficiency.

DISCLOSURE OF THE INVENTION

The present invention has been accomplished with the above circumstances in view, and it is a first object of the present invention to uniformize the distribution of temperature of heat-transfer plates of an annular-shaped heat exchanger in a radial direction and to avoid a reduction in heat exchange efficiency and the generation of an undesirable thermal stress. It is a second object of the present invention to avoid the narrowing of an inlet and outlet of the fluid passage caused by the brazing of the projection stripes. Further, it is a third object of the present invention to ensure that the folding line can be folded easily and precisely without interference with the projection stripes.

To achieve the above first object, according to a first aspect and feature of the present invention, there is provided a heat exchanger having axially extending high-temperature and low-temperature fluid passages defined alternately in a circumferential direction in an annular space that is defined between a radially outer peripheral wall and a radially inner peripheral wall, the heat exchanger being formed from a folding plate blank comprising a plurality of first heat-transfer plates and a plurality of second heat-transfer plates connected alternately through folding lines, the folding plate blank being folded in a zigzag fashion along the folding lines, so that the first and second heat-transfer plates are disposed radiately between the radially outer peripheral wall and the radially inner peripheral wall, whereby the high-temperature and low-temperature fluid passages are defined alternately in the circumferential direction between adjacent ones of the first and second heat-transfer plates, and a high-temperature fluid passage inlet and a high-temperature fluid passage outlet are defined so as to open at axially opposite ends of the high-temperature fluid passage, while a low-temperature fluid passage inlet and a low-temperature fluid passage outlet are defined so as to open at axially opposite ends of the low-temperature fluid passage, each of the first and second heat-transfer plates having a large number of projections formed on opposite surfaces of the plate and bonded together at tip ends of the projections, characterized in that the pitches of arrangement of the projections are set, so that a unit amount of heat transfer is substantially constant in the radial direction.

With the above arrangement, in the heat exchanger comprising the first and second heat-transfer plates disposed radiately in the annular space that is defined between the radially outer peripheral wall and the radially inner peripheral wall to define the high-temperature and low-temperature fluid passages alternately in the circumferential direction, and the large number of projections formed on each of the opposite surfaces of each of the first and second heat-transfer plates and bonded together at the tip ends thereof, pitches of arrangement of the projections are set, so that the unit amount of heat transfer is substantially constant in the radial direction. Therefore, the distribution of temperature of the heat-transfer plate can be uniformized radially to avoid a reduction in heat exchange efficiency and the generation of an undesirable thermal stress.

If the heat transfer coefficient of the first and second heat-transfer plates is represented by K; the area of the first and second heat-transfer plates is represented by A; the specific heat of the fluid is represented by C; and the mass flow rate of the fluid flowing in the heat transfer area is represented by dm/dt, the unit amount $N_{tu}$ of heat transfer is defined by the following equation:

$$N_{tu}=(K\times A)/[C\times(dm/dt)]$$

The pitches of arrangement of the projections, which ensures that the unit amount of heat transfer is substantially constant in the radial direction, are varied depending on the shape of a flow path in the heat exchanger and the shape of the projection, and may be gradually decreased from a radially inner side toward a radially outer side in a certain case and gradually increased from the radially inner side toward the radially outer side in another case.

If the height of the projections is gradually increased from the radially inner side toward the radially outer side, the first and second heat-transfer plates can be positioned precisely radiately.

To achieve the above second object, according to a second aspect and feature of the present invention, there is provided a heat exchanger formed from a folding plate blank comprising a plurality of first heat-transfer plates and a plurality of second heat-transfer plates which are alternately connected together through first and second folding lines, the folding plate blank being folded in a zigzag fashion along the first and second folding lines, so that a gap between adjacent ones of the first folding lines is closed by bonding the first folding lines and a first end plate to each other, while a gap between adjacent ones of the second folding lines is closed by bonding the second folding lines and a second end plate to each other, whereby high-temperature and low-temperature fluid passages are defined alternately between adjacent ones of the first and second heat-transfer plates, and in which opposite ends of each of the first and second heat-transfer plates in a flowing direction are cut into angle shapes each having two end edges, and a high-temperature fluid passage inlet is defined by closing one of said two end edges and opening the other end edge at one end of the high-temperature fluid passage in the flowing direction by brazing of projection stripes provided on the first and second heat-transfer plates to one another, while a high-temperature fluid passage outlet is defined by closing one of said two end edges and opening the other end edge at the other end of the high-temperature fluid passage in the flowing direction by brazing of projection stripes provided on the first and second heat-transfer plates to one another, and further, a low-temperature fluid passage inlet is defined by opening one of said two end edges and closing the other end edge at the other end of the low-temperature fluid passage in the flowing direction by brazing of projection stripes provided on the first and second heat-transfer plates to one another, while a low-temperature fluid passage outlet is defined by opening one of said two end edges and closing the other end edge at one end of the low-temperature fluid passage in the flowing direction by brazing of projection stripes provided on the first and second heat-transfer plates to one another, characterized in that the end edges of the angle shapes have extensions extending outside the projection stripes, the extensions each having projections formed thereon to protrude in a direction opposite from the projection stripes, tip ends of the projections being in abutment against one another.

With the above arrangement, when the tip ends of the projection stripes formed at the end edges of the first and second heat-transfer plates disposed alternately are brazed together to close one of the high-temperature and low-temperature fluid passages with the other opened, even if the end edges of the first and second heat-transfer plates are intended to be curved in a direction opposite from the direction of protrusion of the projection stripes due to a thermal influence of the brazing, the generation of the curving is inhibited by mutual abutment of the tip ends of the projections formed on the extensions extending outwards from the end edges, and the sectional area of flow paths in the inlets and outlets of the high-temperature and low-temperature fluid passages is prevented from being decreased. Moreover, the tip ends of the projection stripes are reliably brought into close contact with one another and hence, the sealability of the high-temperature and low-temperature fluid passages by the projection stripes can be enhanced.

If projections are formed to protrude along the inside of the projection stripes in a direction opposite from the projection stripes with tip ends of the projections being in abutment against one another, the flexure of the projection stripes can be prevented, whereby the projection stripes can reliably be put into abutment against one another to increase the brazing strength.

To achieve the above third object, according to a third aspect and feature of the present invention, there is provided a heat exchanger formed from a folding plate blank comprising a plurality of first heat-transfer plates and a plurality of second heat-transfer plates which are alternately connected together through first and second folding lines, the folding plate blank being folded in a zigzag fashion along the first and second folding lines, so that a gap between adjacent ones of the first folding lines is closed by bonding the first folding lines and a first end plate to each other, while a gap between adjacent ones of the second folding lines is closed by bonding the second folding lines and a second end plate to each other, whereby high-temperature and low-temperature fluid passages are defined alternately between adjacent ones of the first and second heat-transfer plates, opposite ends of each of the first and second heat-transfer plates in a flowing direction being cut into an angle shape having two end edges, one of the two end edges being closed at one end of the high-temperature fluid passage in the flowing direction by projection stripes provided on the first and second heat-transfer plates, with the other of the two end edges being opened, thereby defining a high-temperature fluid passage inlet, while one of the two end edges being closed at the other end of the high-temperature fluid passage in the flowing direction by projection stripes provided on the first and second heat-transfer plates, with the other of the two end edges being opened, thereby defining a high-temperature fluid passage outlet, and further, the other of the two end edges being closed at the other end of the low-temperature fluid passage in the flowing direction by projection stripes provided on the first and second heat-transfer plates, with one of the two end edges being opened, thereby defining a low-temperature fluid passage inlet, while the other of the two end edges being closed at one end of the low-temperature fluid passage in the flowing direction by projection stripes provided on the first and second heat-transfer plates, with one of the two edge edges being opened, thereby defining a low-temperature fluid passage outlet, characterized in that a gap is defined between tip ends of the projection stripes opposed to each other and forming a pair on opposite sides of each of the folding lines, and the folding line is disposed within the gap.

With the above arrangement, when the folding plate blank is folded, the folded area at the folding line does not interfere with the projection stripes to facilitate the folding, because the folding line is disposed within the gap defined between the tip ends of the pair of projection stripes opposed to each other on the opposite side of the folding line. Moreover, a simple rectilinear folding may be carried out and hence, a good finish is provided.

If a circumferential length of the folded area at each of the folding lines is set equal to a width of the gap, the projection stripes can smoothly be connected to the folded area to enhance the sealability between the first and second end plates.

If the projection stripes are formed so as not to interfere with the folded area at each of the folding lines, it is possible to reliably prevent the blow-by of the fluid from the folded area.

BRIEF DESCRIPTION OF THE DRAWINGS

FIGS. 1 to 18 show one embodiment of the present invention, wherein FIG. 1 is a side view of an entire gas turbine engine;

FIG. 2 is a sectional view taken along a line 2—2 in FIG. 1;

FIG. 3 is an enlarged sectional view taken along a line 3—3 in FIG. 2 (a sectional view of combustion gas passages);

FIG. 4 is an enlarged sectional view taken along a line 4—4 in FIG. 2 (a sectional view of air passages);

FIG. 5 is an enlarged sectional view taken along a line 5—5 in FIG. 3;

FIG. 6 is an enlarged sectional view taken along a line 6—6 in FIG. 3;

FIG. 7 is a developed view of a folding plate blank;

FIG. 8 is a perspective view of an essential portion of a heat exchanger;

FIG. 9 is a pattern view showing flows of a combustion gas and air;

FIG. 13 is an enlarged view of a portion indicated by 13 in FIG. 7;

FIG. 14 is an enlarged view of a portion indicated by 14 in FIG. 7;

FIG. 15 is a partially perspective view of the heat exchanger, corresponding to FIG. 13;

FIG. 16 is a partially perspective view of the heat exchanger, corresponding to FIG. 14;

FIG. 17 is a sectional view taken along a line 17—17 in FIG. 15; and FIG. 18 is a sectional view taken along a line 18—18 in FIG. 16.

BEST MODE FOR CARRYING OUT THE INVENTION

The present invention will now be described by way of an embodiment with reference to the accompanying drawings.

Figure 1:
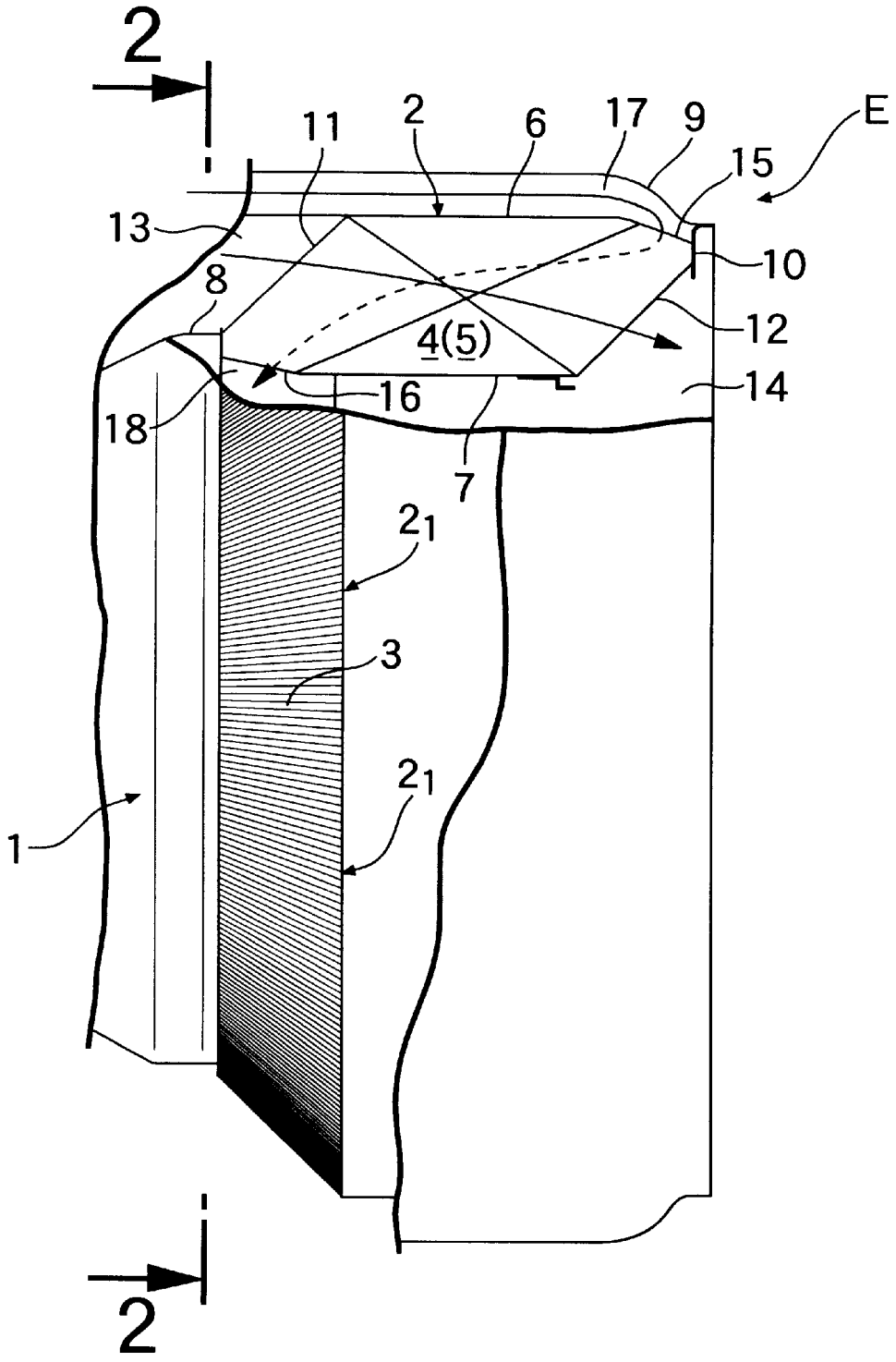
Figure 2:
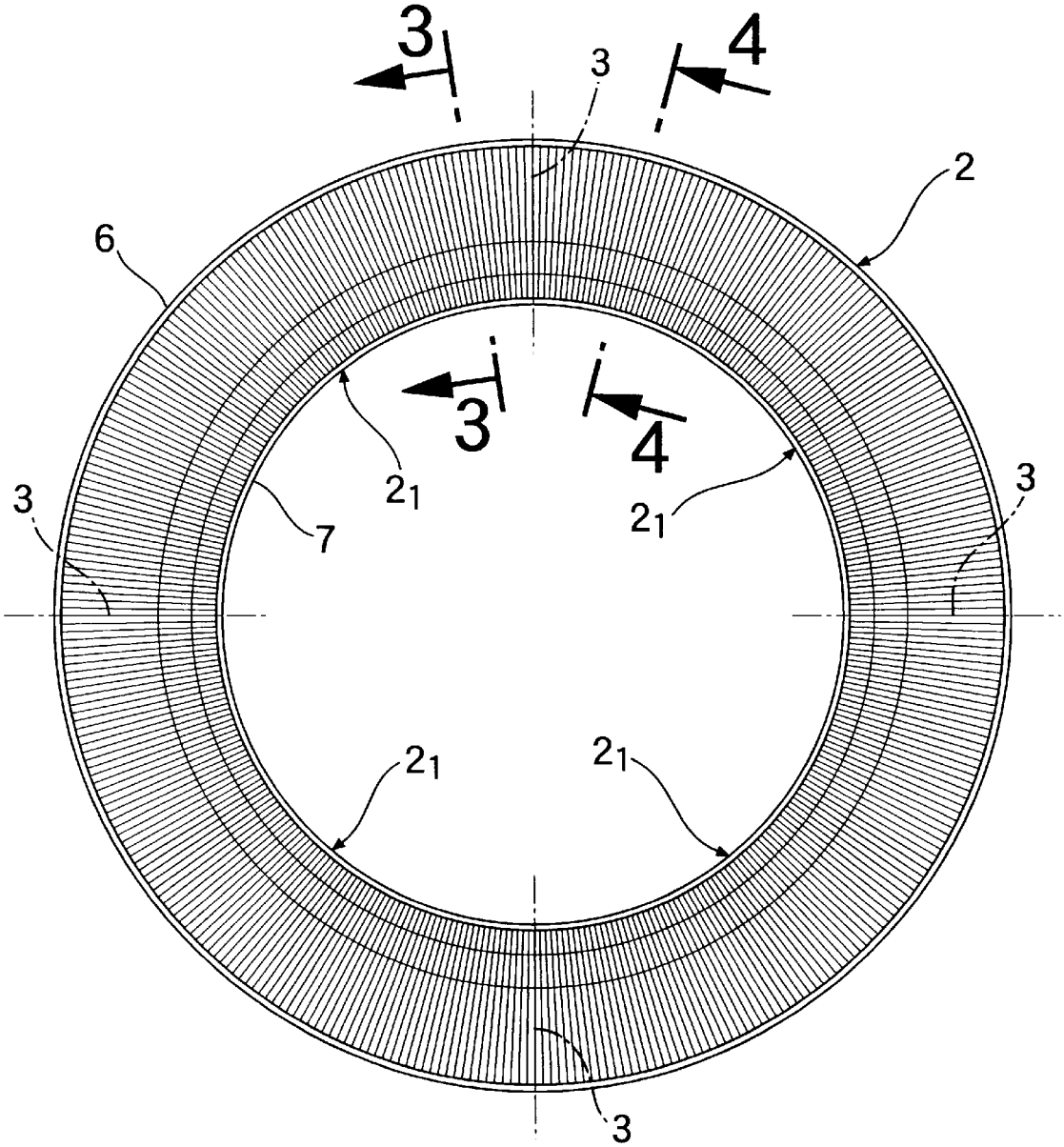

As shown in FIGS. 1 and 2, a gas turbine engine E includes an engine body 1 in which a combustor, a compressor, a turbine and the like (which are not shown) are accommodated. An annular-shaped heat exchanger 2 is disposed to surround an outer periphery of the engine body 1. The heat exchanger 2 comprises four modules $\mathbf{2}_1$ having a center angle of 90° and arranged in a circumferential direction with bond surfaces 3 interposed therebetween. Combustion gas passages 4 and air passages 5 are circumferentially alternately provided in the heat exchanger 2 (see FIGS. 5 and 6), so that a combustion gas of a relative high temperature passed through turbine is passed through the combustion gas passages 4, and air of a relative low temperature compressed in the compressor is passed through the air passages 5. A section in FIG. 1 corresponds to the combustion gas passages 4, and the air passages 5 are defined adjacent this side and the other side of the combustion gas passages 4.

The sectional shape of the heat exchanger 2 taken along an axis is an axially longer and radially shorter flat hexagonal shape. A radially outer peripheral surface of the heat exchanger 2 is closed by a larger-diameter cylindrical outer casing 6, and a radially inner peripheral surface of the heat exchanger 2 is closed by a smaller-diameter cylinder inner casing 7. A front end side (a left side in FIG. 1) in the section of the heat exchanger 2 is cut into an unequal-length angle shape, and an end plate 8 connected to an outer periphery of the engine body 1 is brazed to an end surface corresponding to an apex of the angle shape. A rear end side (a right side in FIG. 1) in the section of the heat exchanger 2 is cut into an unequal-length angle shape, and an end plate 10 connected to a rear outer housing 9 is brazed to an end surface corresponding to an apex of the angle shape.

Each of the combustion gas passages 4 in the heat exchanger 2 includes a combustion gas passage inlet 11 and a combustion gas passage outlet 12 at the left and upper portion and the right and lower portion of FIG. 1, respectively. A combustion gas introducing space (referred to as a combustion gas introducing duct) 13 defined along the outer periphery of the engine body 1 is connected at its downstream end to the combustion gas passage inlet 11. A combustion gas discharging space (referred to as a combustion gas discharging duct) 14 extending within the engine body 1 is connected at its upstream end to the combustion gas passage outlet 12.

Each of the air passages 5 in the heat exchanger 2 includes an air passage inlet 15 and an air passage outlet 16 at the right and upper portion and the left and lower portion of FIG. 1, respectively. An air introducing space (referred to as an air introducing duct) 17 defined along an inner periphery of the rear outer housing 9 is connected at its downstream end to the air passage inlet 15. An air discharging space (referred to as an air discharging duct) 18 extending within the engine body 1 is connected at its upstream end to the air passage outlet 16.

Figure 3:
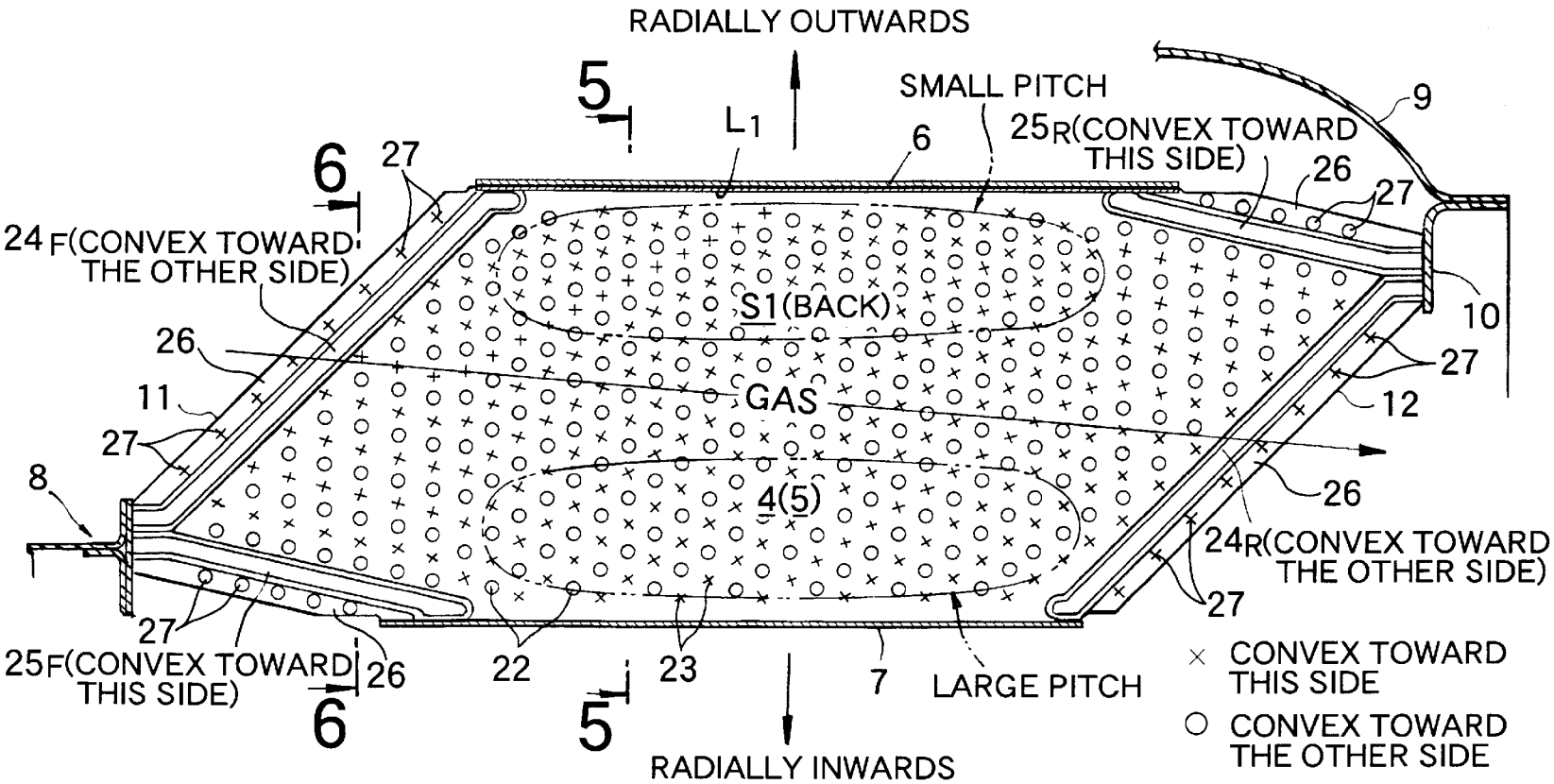
Figure 4:
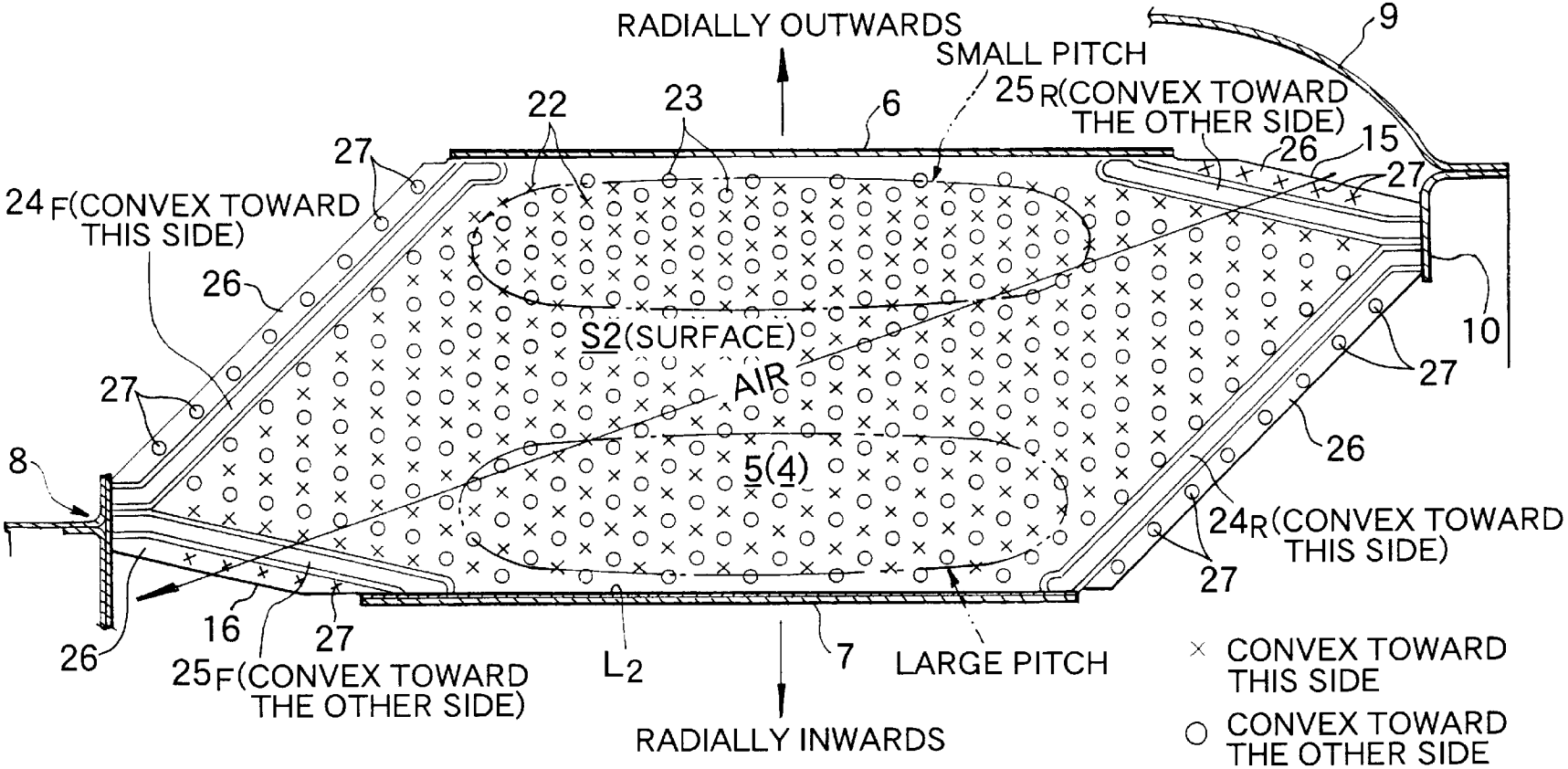
Figure 9:
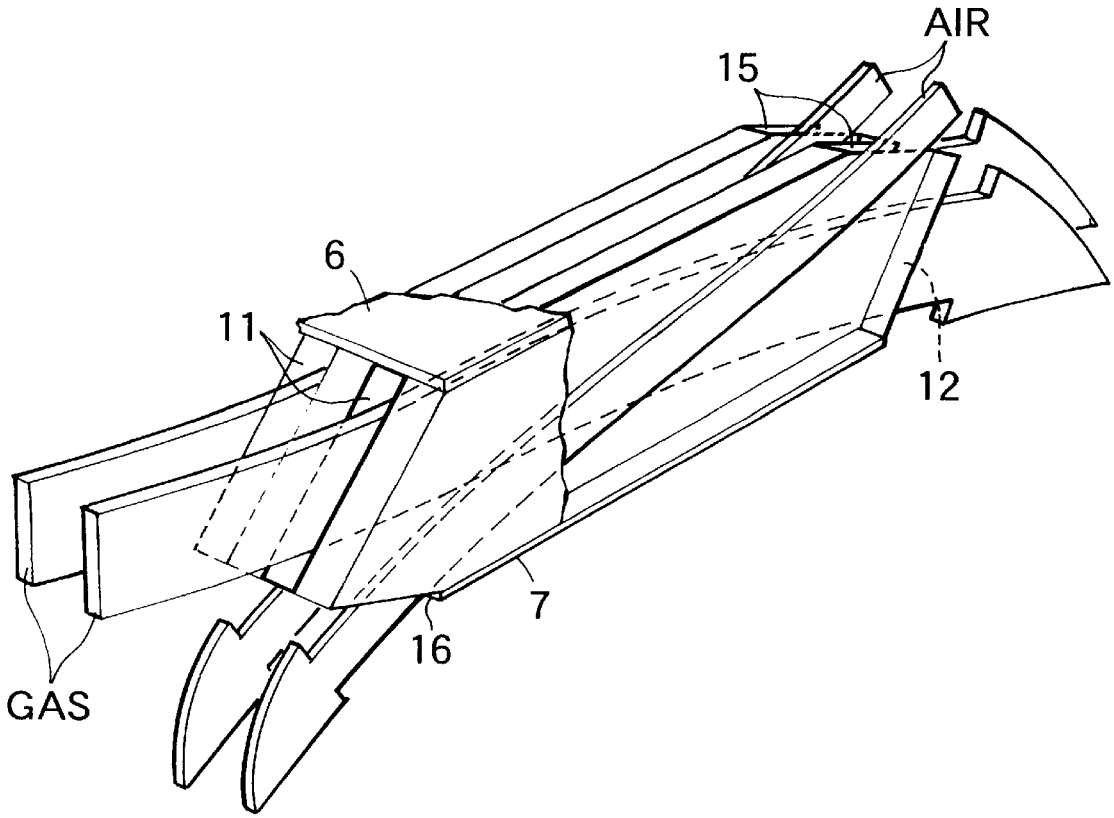

In this manner, the combustion gas and the air flow in opposite directions from each other and cross each other as shown in FIGS. 3, 4 and 9, whereby a counter flow and a so-called cross-flow are realized with a high heat-exchange efficiency. Thus, by allowing a high-temperature fluid and a low-temperature fluid to flow in opposite directions from each other, a large difference in temperature between the high-temperature fluid and the low-temperature fluid can be maintained over the entire length of the flow paths, thereby enhancing the heat-exchange efficiency.

The temperature of the combustion gas which has driven the turbine is about 600 to 700° C. in the combustion gas passage inlets 11. The combustion gas is cooled down to about 300 to 400° C. in the combustion gas passage outlets 12 by conducting a heat-exchange between the combustion gas and the air when the combustion gas passes through the combustion gas passages 4. On the other hand, the temperature of the air compressed by the compressor is about 200 to 300° C. in the air passage inlets 15. The air is heated up to about 500 to 600° C. in the air passage outlets 16 by conducting a heat-exchange between the air and the combustion gas, which occurs when the air passes through the air passages 5.

The structure of the heat exchanger 2 will be described below with reference to FIGS. 3 to 8.

Figure 7:
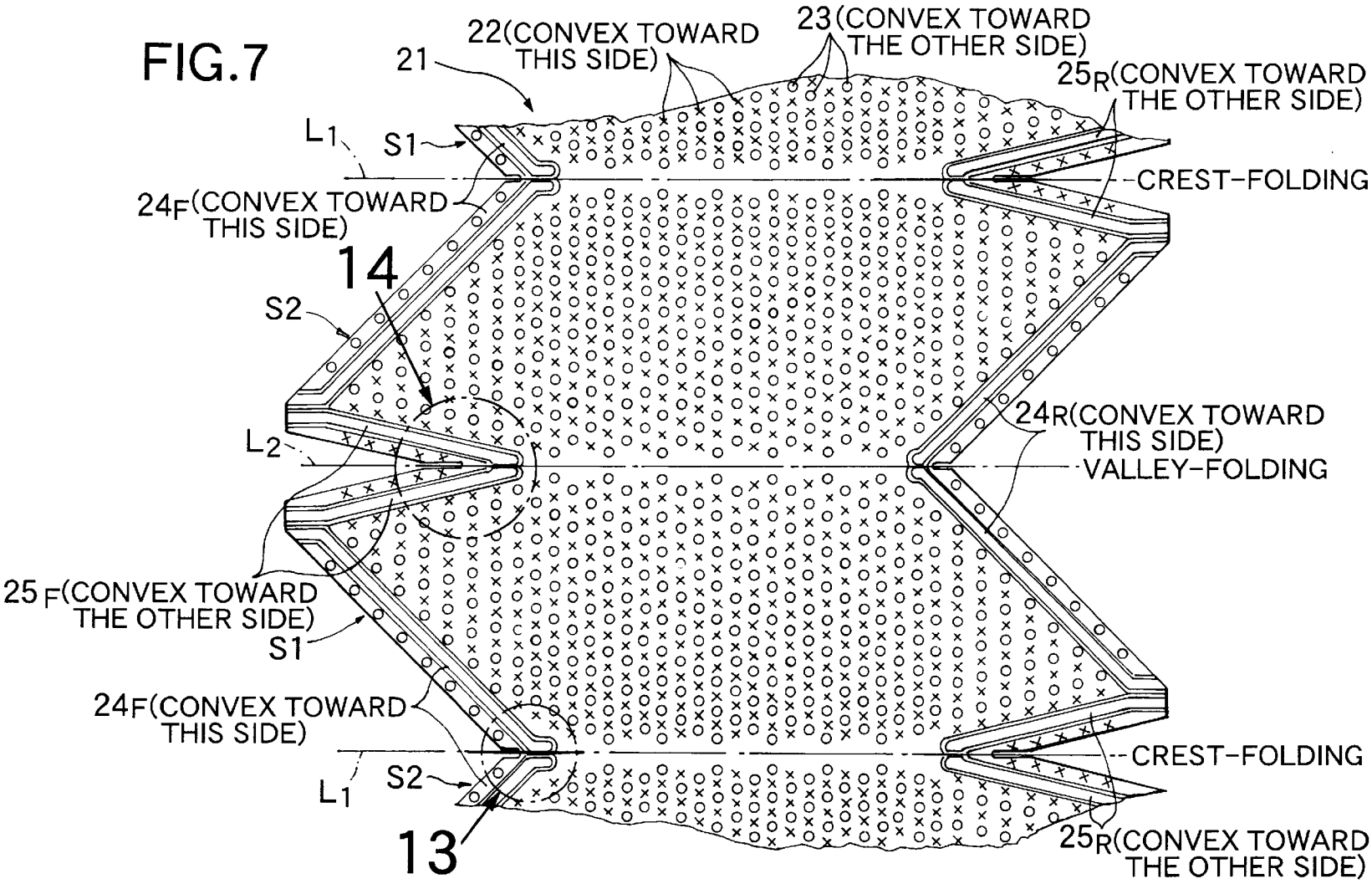
Figure 8:
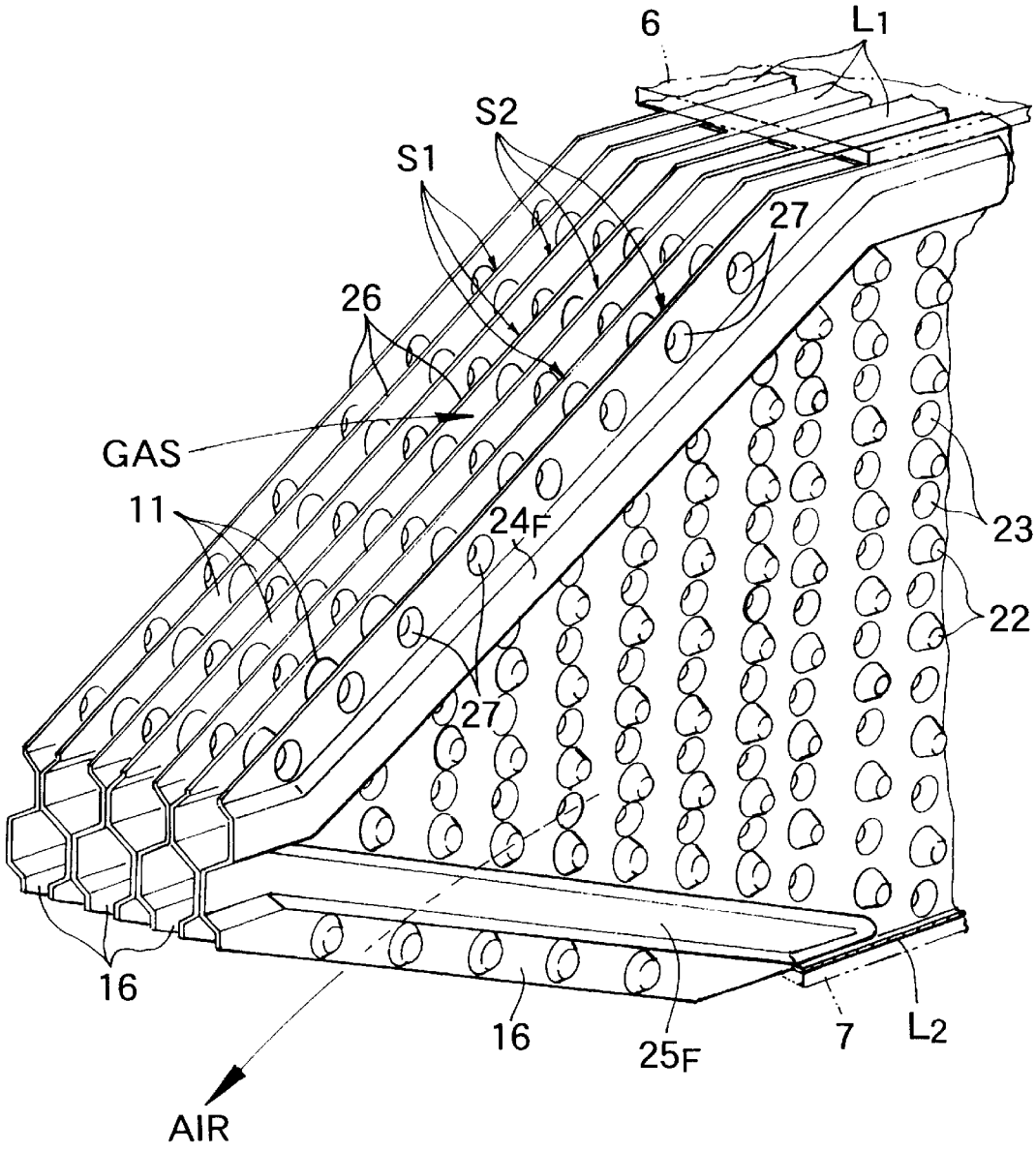

As shown in FIGS. 3, 4 and 7, each of the modules $\mathbf{2}_1$ of the heat exchanger 2 is made from a folding plate blank 21 produced by previously cutting a thin metal plate such as a stainless steel into a predetermined shape and then forming an irregularity on a surface of the cut plate by pressing. The folding plate blank 21 is comprised of first heat-transfer plates S1 and second heat-transfer plates S2 disposed alternately, and is folded into a zigzag fashion along crest-folding lines $L_1$ and valley-folding lines $L_2$. The term "crest-folding" means folding into a convex toward this side or a closer side from the drawing sheet surface, and the term "valley-folding" means folding into a convex toward the other side or a far side from the drawing sheet surface. Each of the crest-folding lines $L_1$ and the valley-folding lines $L_2$ is not a simple straight line, but actually comprises an arcuate folding line or two parallel and adjacent folding lines for the purpose of forming a predetermined space between each of the first heat-transfer plates Si and each of the second heat-transfer plates S2.

A large number of first projections 22 and a large number of second projections 23, which are disposed at unequal distances, are formed on each of the first and second heat-transfer plates S1 and S2 by pressing. The first projections 22 indicated by a mark X in FIG. 7 protrude toward this side on the drawing sheet surface of FIG. 7, and the second projections 23 indicated by a mark O in FIG. 7 protrude toward the other side on the drawing sheet surface of FIG. 7. The first and second projections 22 and 23 are arranged alternately (i.e., so that the first projections 22 are not continuous to one another and the second projections 23 are not continuous to one another).

First projection stripes $\mathbf{24}_F$ and second projection stripes $\mathbf{25}_F$ are formed by pressing at those front and rear ends of the first and second heat-transfer plates S1 and S2 which are cut into the angle shape. The first projection stripes $\mathbf{24}_F$ protrude toward this side on the drawing sheet surface of FIG. 7, and the second projection stripes $\mathbf{25}_F$ protrude toward the other side on the drawing sheet surface of FIG. 7. In any of the first and second heat-transfer plates S1 and S2, a pair of the front and rear first projection stripes $\mathbf{24}_F$, $\mathbf{24}_R$ are disposed at diagonal positions, and a pair of the front and rear second projection stripes $\mathbf{25}_F$, $\mathbf{25}_R$ are disposed at other diagonal positions.

The first projections 22, the second projections 23, the first projection stripes $\mathbf{24}_F$, $\mathbf{24}_R$ and the second projection stripes $\mathbf{25}_F$, $\mathbf{25}_R$ of the first heat-transfer plate S1 shown in FIG. 3 are in an opposite recess-projection relationship with respect to that in the first heat-transfer plate S1 shown in FIG. 7. This is because FIG. 3 shows a state in which the first heat-transfer plate SI is viewed from the back side.

Figures 5, 5A, 5B, 5C:
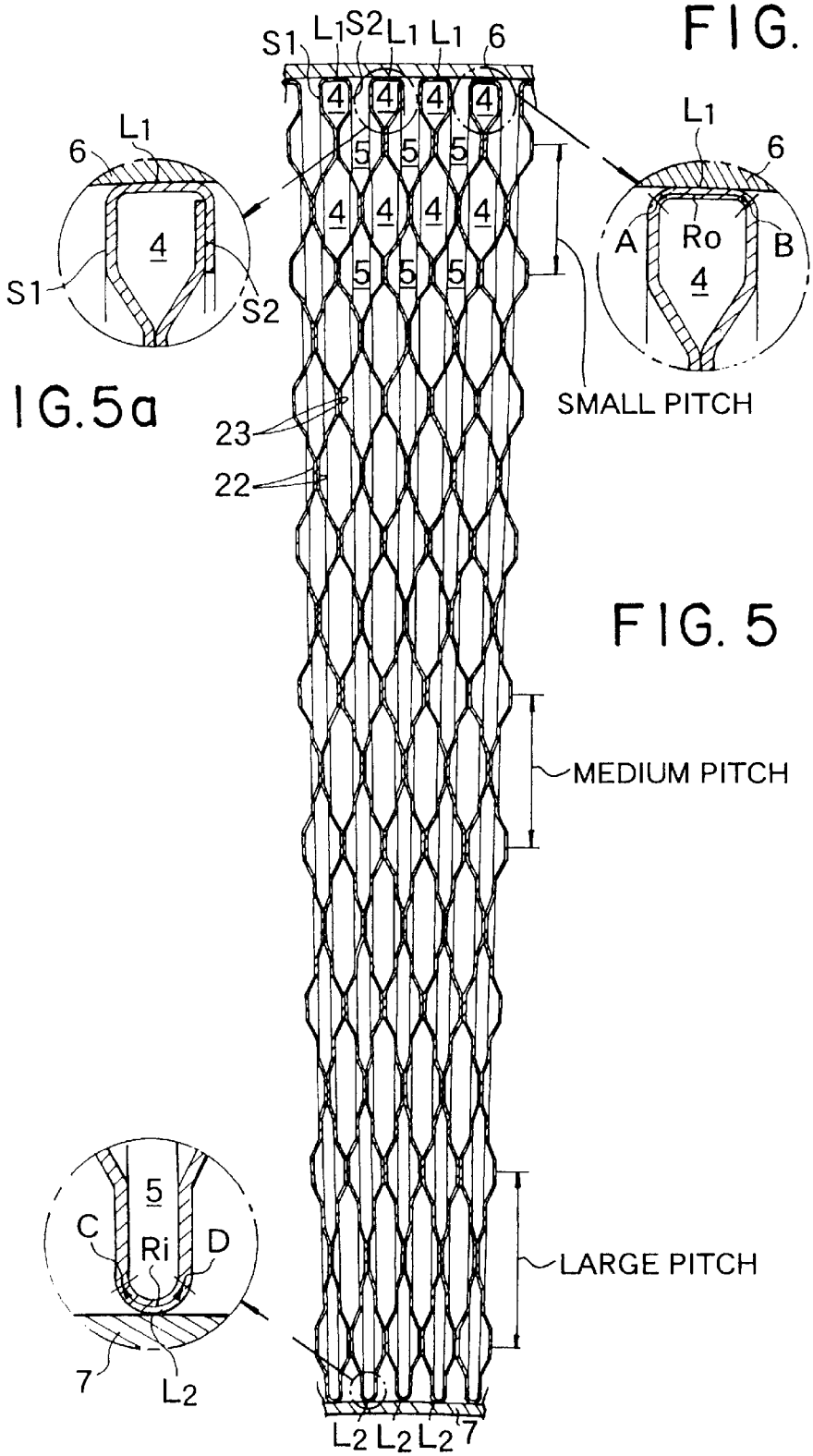
Figure 6:
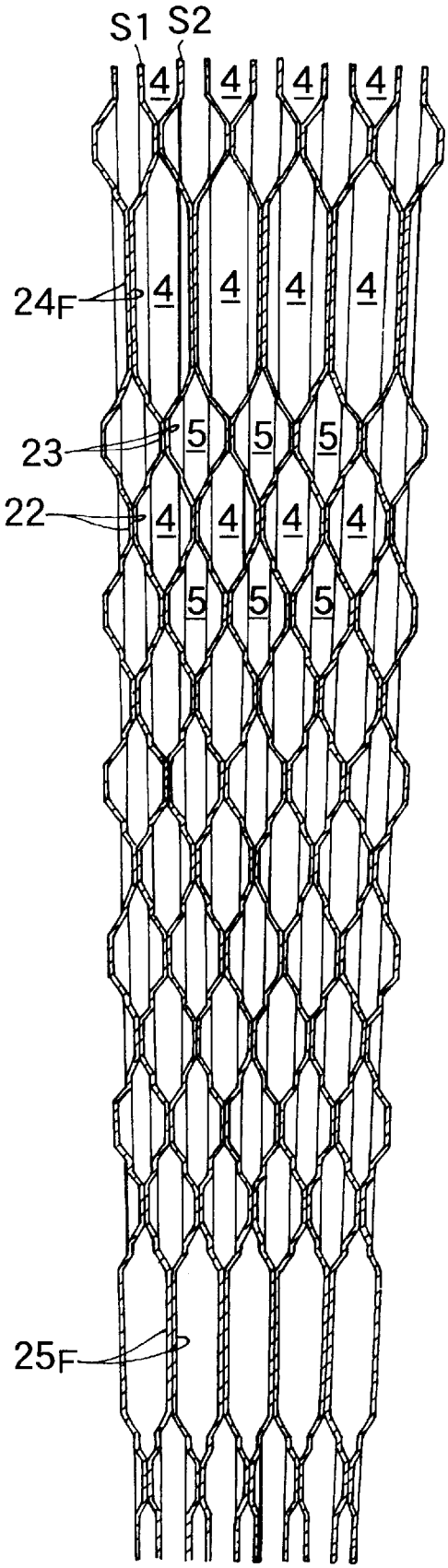

As can be seen from FIGS. 5 to 7, when the first and second heat-transfer plates S1 and S2 of the folding plate blank 21 are folded along the crest-folding lines $L_1$ to form the combustion gas passages 4 between both the heat-transfer plates S1 and S2, tip ends of the second projections 23 of the first heat-transfer plate S1 and tip ends of the second projections 23 of the second heat-transfer plate S2 are brought into abutment against each other and brazed to each other. In addition, the second projection stripes $\mathbf{25}_F$, $\mathbf{25}_R$ of the first heat-transfer plate S1 and the second projection stripes $\mathbf{25}_F$, $\mathbf{25}_R$ of the second heat-transfer plate S2 are brought into abutment against each other and brazed to each other. Thus, a left lower portion and a right upper portion of the combustion gas passage 4 shown in FIG. 3 are closed, and each of the first projection stripes $\mathbf{24}_F$, $\mathbf{24}_R$ of the first heat-transfer plate S1 and each of the first projection stripes $\mathbf{24}_F$, $\mathbf{24}_R$ of the second heat-transfer plate S2 are opposed to each other with a gap left therebetween. Further, the combustion gas passage inlet 11 and the combustion gas passage outlet 12 are defined in a left, upper portion and a right, lower portion of the combustion gas passage 4 shown in FIG. 3, respectively.

When the first heat-transfer plates S1 and the second heat-transfer plates S2 of the folding plate blank 21 are folded along the valley-folding line $L_2$ to form the air passages 5 between both the heat-transfer plates S1 and S2, the tip ends of the first projections 22 of the first heat-transfer plate S1 and the tip ends of the first projections 22 of the second heat-transfer plate S2 are brought into abutment against each other and brazed to each other. In addition, the first projection stripes $\mathbf{24}_F$, $\mathbf{24}_R$ of the first heat-transfer plate S1 and the first projection stripes $\mathbf{24}_F$, $\mathbf{24}_R$ of the second heat-transfer plate S2 are brought into abutment against each other and brazed to each other. Thus, a left upper portion and a right lower portion of the air passage 5 shown in FIG. 4 are closed, and each of the second projection stripes $\mathbf{25}_F$, $\mathbf{25}_R$ of the first heat-transfer plate S1 and each of the second projection stripes $\mathbf{25}_F$, $\mathbf{25}_R$ of the second heat-transfer plate S2 are opposed to each other with a gap left therebetween. Further, the air passage inlet 15 and the air passage outlet 16 are defined at a right upper portion and a left lower portion of the air passage 5 shown in FIG. 4, respectively.

A state in which the air passages 5 have been closed by the first projection stripes $\mathbf{24}_F$ is shown in an upper portion (a radially outer portion) of FIG. 6, a state in which the combustion gas passages 4 have been closed by the second projection stripes $\mathbf{25}_F$ is shown in a lower portion (a radially outer portion) of FIG. 6.

Each of the first and second projections 22 and 23 has a substantially truncated conical shape, and the tip ends of the first and second projections 22 and 23 are in surface contact with each other to enhance the brazing strength. Each of the first and second projection stripes $\mathbf{24}_F$, $\mathbf{24}_R$ and $\mathbf{25}_F$, $\mathbf{25}_R$ has also a substantially trapezoidal section, and the tip ends of the first and second projection stripes $\mathbf{24}_F$, $\mathbf{24}_R$ and $\mathbf{25}_F$, $\mathbf{25}_R$ are also in surface contact with each other to enhance the brazing strength. As can be seen from FIGS. 3 and 4, narrower extensions 26 are formed outside the first and second projection stripes $\mathbf{24}_F$ and $\mathbf{25}_f$, at the angle-cut front ends and outside the first and second projection stripes $\mathbf{24}_R$ and $\mathbf{25}_R$ at the angle-cut rear ends of each of the first and second heat-transfer plates S1 and S2. Five or eight curvature-preventing projections 27 are formed in one row in each of the extensions 26. The curvature-preventing projections 27 protrude in a direction opposite from the direction of protrusion of the first projection stripes $\mathbf{24}_F$ and $\mathbf{24}_R$ and the second projection stripes $\mathbf{25}_F$ and $\mathbf{25}_R$ adjacent the curvature-preventing projections 27. In other words, if the first projection stripes $\mathbf{24}_F$ and $\mathbf{24}_R$ and the second projection stripes $\mathbf{25}_F$ and $\mathbf{25}_R$ protrude to this side, the curvature-preventing projections 27 adjacent these projection stripes protrude to the other side. If the first projection stripes $\mathbf{24}_F$ and $\mathbf{24}_R$ and the second projection stripes $\mathbf{25}_F$ and $\mathbf{25}_R$ protrude to the other side, the curvature-preventing projections 27 adjacent these projection stripes protrude to this side.

Figure 12A:
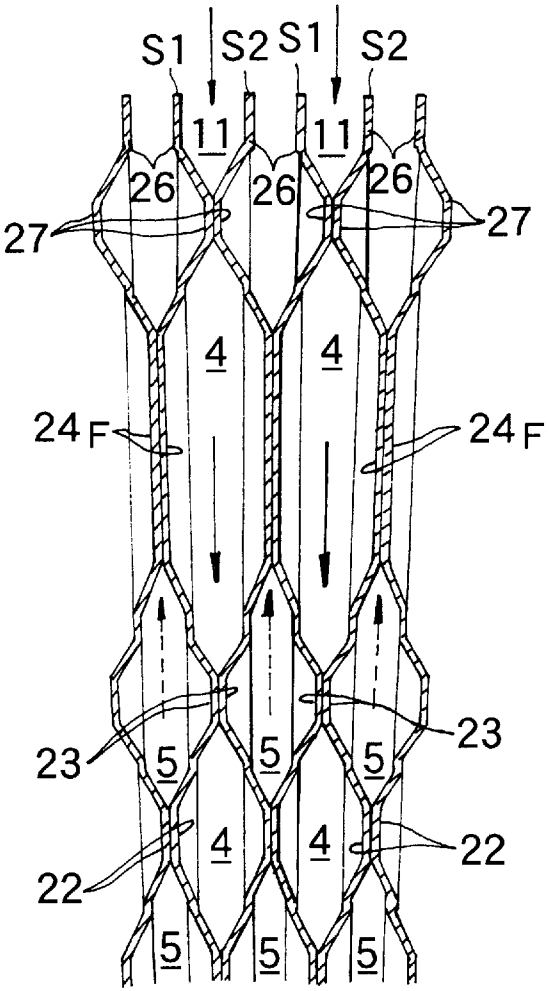
FIGS. 12A and 12B are views corresponding to an essential portion shown in FIG. 6 for explaining the operation.

FIG. 12A shows the section in the vicinity of the combustion gas passage inlet 11 connected to the combustion gas passages 4. Tip ends of the curvature-preventing projections 27 provided on the extensions 26 outside the first projection stripes $\mathbf{24}_F$ are brought into abutment against each other and brazed to each other, so that the air passages 5 are closed by the brazing of the first projection stripes $\mathbf{24}_F$ to each other. A combustion gas shown by an arrow of a solid line flows into the combustion gas passage inlet 11 and is guided through a periphery of the curvature-preventing projections 27 into the combustion gas passages 4. On the other hand, the flow of air (shown by an arrow of a dashed line) through the air passages 5 is inhibited by the abutment of the first projection stripes $\mathbf{24}_F$ against each other.

Even in the extensions 26 in the vicinity of the combustion gas passage outlet 12, the air passage inlet 15 and the air passage outlet 16, the tip ends of the curvature preventing projections 27 are brought into abutment against each other and brazed to each other, as in the above-described combustion gas inlet 11.

Figure 12B:
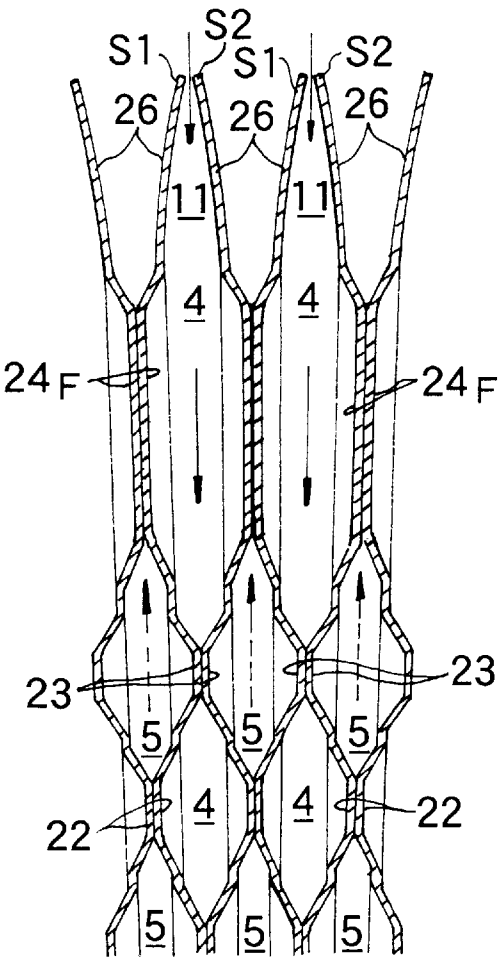

If it is supposed that each of the extensions 26 is not provided with the curvature-preventing projections 27, as shown in FIG. 12B, the extension 26 is curved in the direction opposite from the direction of protrusion of the first projection stripes $\mathbf{24}_F$ due to a thermal influence when the first projection stripes $\mathbf{24}_F$ in abutment against each other are brazed to each other, whereby the sectional area of the flow path in the combustion gas passage inlet 11 is reduced.

However, if the curvature-preventing projections 27 are provided on each of the extensions 26, as shown in FIG. 12A, the curving of the extension 26 can be prevented. Thus, it is possible not only to reliably avoid a reduction in sectional area of the flow path in the combustion gas passage inlet 11, but also to forcibly bring the first projection stripes $\mathbf{24}_F$ into close contact with each other to enhance the sealability. Likewise, it is possible to avoid a reduction in sectional area of the flow path in the combustion gas passage outlet 12, the air passage inlet 15 and the air passage outlet 16, and to reliably bring the first projection stripes $\mathbf{24}_F$, $\mathbf{24}_R$ as well as the second projection stripes $\mathbf{25}_F$, $\mathbf{25}_R$ into close contact with each other.

As can be seen from FIGS. 3 and 4, the first projections 22 or the second projections 23 are formed in one row inside the first projection stripes $\mathbf{24}_F$, $\mathbf{24}_R$ and the second projection stripes $\mathbf{25}_F$, $\mathbf{25}_R$ to protrude in the same direction as the curvature-preventing projections 27 provided outside the projection stripes (namely, on the extensions 26). The first projection stripes $\mathbf{24}_F$, $\mathbf{24}_R$ as well as the second projection stripes $\mathbf{25}_F$, $\mathbf{25}_R$ are fixed on both of inner and outer sides by bringing the tip ends of the first projections 22 or the second projections 23 into abutment against each other, whereby the flexure of these projection stripes is reliably prevented. As a result, it is possible to reliably bring the tip ends of the first projection stripes $\mathbf{24}_F$, $\mathbf{24}_R$ as well as the second projection stripes $\mathbf{25}_F$, $\mathbf{25}_R$ into close contact with each other to enhance the brazing strength.

As can be seen from FIG. 5, radially inner peripheral portions of the air passages 5 are automatically closed, because they correspond to the folded portion (the valley-folding line $L_2$) of the folding plate blank 21, but radially outer peripheral portions of the air passages 5 are opened, and such opening portions are closed by brazing to the outer casing 6. On the other hand, radially outer peripheral portions of the combustion gas passages 4 are automatically closed, because they correspond to the folded portion (the crest-folding line $L_1$) of the folding plate blank 21, but radially inner peripheral portions of the combustion gas passages 4 are opened, and such opening portions are closed by brazing to the inner casing 7.

At an axially central portion of the heat exchanger 2 sandwiched between the outer casing 6 and the inner casing 7, the first projection stripes $\mathbf{24}_F$, $\mathbf{24}_R$ and the second projection stripes $\mathbf{25}_F$, $\mathbf{25}_R$ are not provided in the first and second heat-transfer plates S1 and S2. Therefore, the maintaining of the spacing between the first and second heat-transfer plates S1 and S2 is performed by the abutment of the first projections 22 against each other and the abutment of the second projections 23 against each other, leading to an enhanced bonding ability of the first and second projections 22 and 23.

When the folding plate blank 21 is folded in the zigzag fashion, the adjacent crest-folding lines $L_1$ cannot be brought into direct contact with each other, but the distance between the crest-folding lines $L_1$ is maintained constant by the contact of the first projections 22 to each other. In addition, the adjacent valley-folding lines $L_2$ cannot be brought into direct contact with each other, but the distance between the valley-folding lines $L_2$ is maintained constant by the contact of the second projections 23 to each other.

Figure 13:
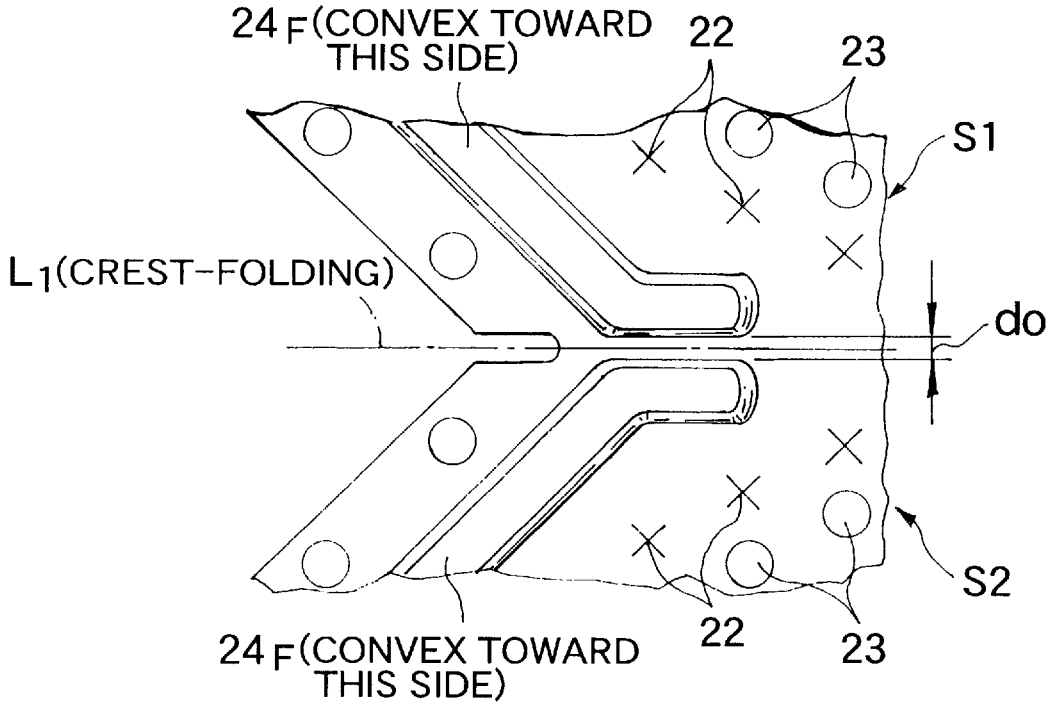

As shown in FIG. 13, the first projection stripes $\mathbf{24}_F$ of the first heat-transfer plate S1 and the first projection stripes $\mathbf{24}_F$ of the second heat-transfer plate S2 extend toward the crest-folding lines Li provided between both the heat-transfer plates S1 and S2, and the tip ends of a pair of the first projection stripes $\mathbf{24}_F$, $\mathbf{24}_F$ terminate with a gap of a width do left on opposite sides of the crest-folding line $L_1$. Namely, the crest-folding line $L_1$ passes through the center of the gap of the width d defined between the tip ends of the pair of first projection stripes $\mathbf{24}_F$, $\mathbf{24}_F$. The gap are connected in the same plane to bodies (flat plate portions on which the first and second projections 22 and 23 are provided) of the first and second heat-transfer plates S1 and S2.

Figure 14:
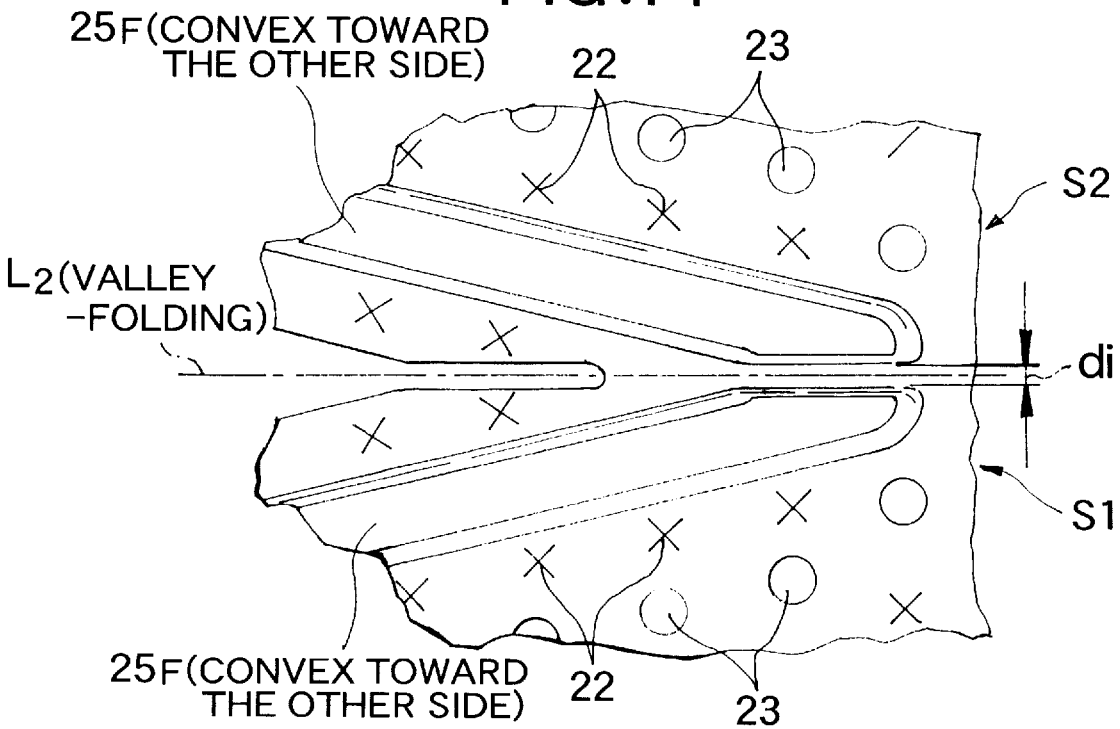

As shown in FIG. 14, the second projection stripes $\mathbf{25}_F$ of the first heat-transfer plate S1 and the second projection stripes $\mathbf{25}_F$ of the second heat-transfer plate S2 extend toward the valley-folding lines $L_2$ provided between both the heat-transfer plates S1 and S2, and the tip ends of a pair of the second projection stripes $\mathbf{25}_F$, $\mathbf{25}_F$ terminate with a gap of a width di left on opposite sides of the valley-folding line $L_2$. Namely, the valley-folding line $L_2$ passes through the center of the gap of the width di defined between the tip ends of the pair of second projection stripes $\mathbf{25}_F$, $\mathbf{25}_F$. The gaps are connected in the same plane to bodies (flat plate portions on which the first and second projections 22 and 23 are provided) of the first and second heat-transfer plates S1 and S2.

As shown within a circle at a right and upper region in FIG. 5, the radially outer ends of the first and second heat-transfer plates S1 and S2 are connected to the outer casing 6 on the crest-folding lines $L_1$, and the combustion gas passages 4 and the air passages 5 are alternately defined even in the vicinity of the outer casing 6 to ensure that the heat exchange is carried out efficiently. The circumferential length Ro of a folded area at each of the crest-folding lines $L_1$, i.e., the circumferential length Ro between points A and B at which the crest-folding line $L_1$ is folded, is set equally to the width do of the gap defined between the tip ends of the pair of first projection stripes $\mathbf{24}_F$, $\mathbf{24}_F$.

As shown within a circle at a left and lower region in FIG. 5, the radially inner ends of the first and second heat-transfer plates S1 and S2 are connected to the inner casing 7 on the valley-folding lines $L_2$, and the combustion gas passages 4 and the air passages 5 are alternately defined even in the vicinity of the inner casing 7 to ensure that the heat exchange is carried out efficiently. The circumferential length Ro of a folded area at each of the valley-folding lines $L_2$, i.e., the circumferential length Ro between points C and D at which the valley-folding line $L_2$ is folded, is set equally to the width di of the gap defined between the tip ends of the pair of second projection stripes $\mathbf{25}_F$, $\mathbf{25}_F$.

Figure 15:
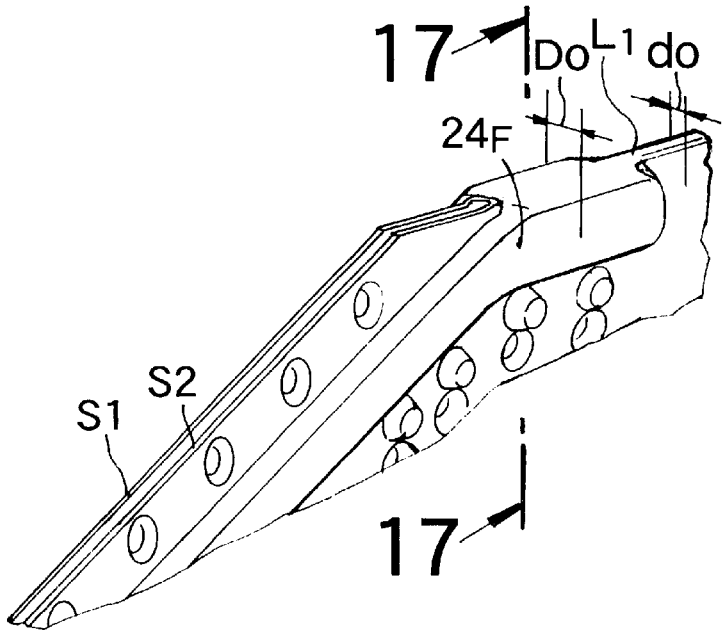
Figure 17:
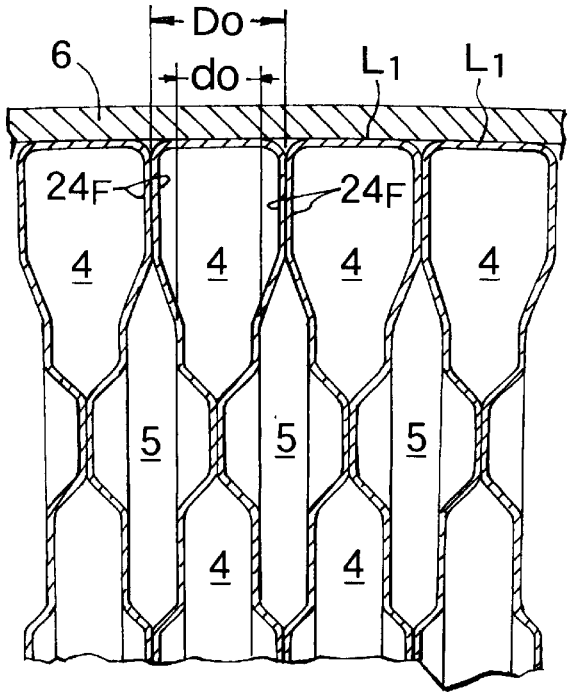

As can be seen from FIGS. 15 and 17, when the crest-folding line $L_1$ is folded over its entire length, sidewalls of the pair of first projection stripes $\mathbf{24}_F$, $\mathbf{24}_F$ located on opposite sides of the crest-folding line Li are smoothly connected to each other on opposite sides of the gap having the width do to form a flat surface having a width Do. The flat surface having the width Do is bonded to the outer casing 6 with no gap left therebetween and hence, the air in the air passage 5 is prevented from being leaked between the first projection stripes $\mathbf{24}_F$, $\mathbf{24}_F$ and the outer casing 6.

Figure 16:
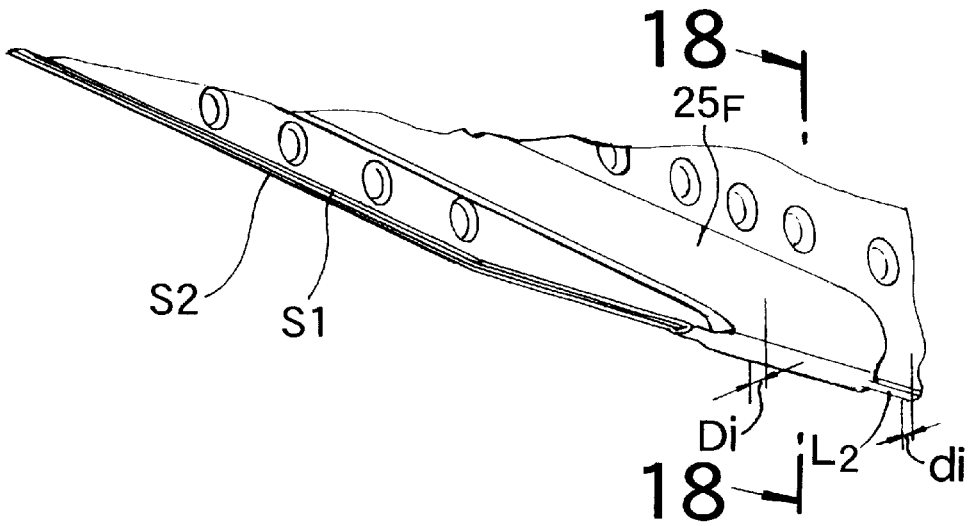
Figure 18:
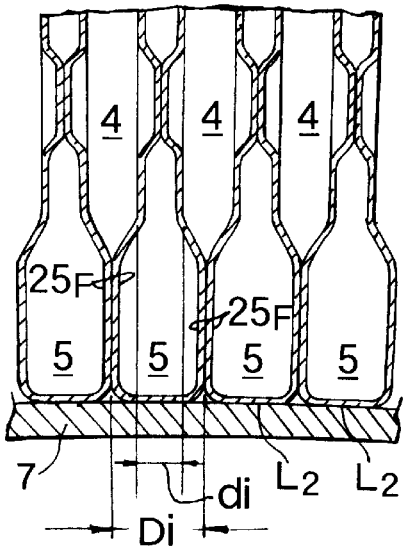

As can be seen from FIGS. 16 and 18, when the valley-folding line $L_2$ is folded over its entire length, sidewalls of the pair of second projection stripes $\mathbf{25}_F$, $\mathbf{25}_F$ located on opposite sides of the valley-folding line $L_2$ are smoothly connected to each other on opposite sides of the gap having the width di to form a flat surface having a width Di. The flat surface having the width Di is bonded to the inner casing 7 with no gap left therebetween and hence, the combustion gas in the combustion gas passage 6 is prevented from being leaked between the second projection stripes $\mathbf{25}_F$, $\mathbf{25}_F$ and the inner casing 7.

As described above, the crest-folding line $L_1$ is disposed in the gap between the tip ends of the pair of first projection stripes $\mathbf{24}_F$, $\mathbf{24}_F$, and the valley-folding line $L_2$ is disposed in the gap between the tip ends of the pair of second projection stripes $\mathbf{25}_F$, $\mathbf{25}_F$. Therefore, the crest-folding line $L_1$ and the valley-folding line $L_2$ cannot interfere with the first projection stripes $\mathbf{24}_F$, $\mathbf{24}_F$ and the second projection stripes $\mathbf{25}_F$, $\mathbf{25}_F$ during folding thereof. Thus, it is easy to carry out the folding operation, thereby providing a good finish of the folded area, and moreover, enabling the prevention of the blow-by of the fluid from the folded area.

Particularly, the width f of the gap between the tip ends of the pair of first projection stripes $\mathbf{24}_F$, $\mathbf{24}_F$ is set equally to the circumferential length Ro of the folded area at the crest-folding line $L_1$, and the width di of the gap between the tip ends of the pair of second projection stripes $\mathbf{25}_F$, $\mathbf{25}_F$ is set equally to the circumferential length Ri of the folded area at the valley-folding line $L_2$. Therefore, the flat area having the width Do can be formed at the tip ends of the first projection stripes $\mathbf{24}_F$, $\mathbf{24}_F$ to improve the sealability against the outer casing 6, and the flat area having the width Di can be formed at the tip ends of the second projection stripes $\mathbf{25}_F$, $\mathbf{25}_F$ to improve the sealability against the inner casing 7.

The structure regarding the front first and second projection stripes $\mathbf{24}_F$, and $\mathbf{25}_F$ has been described above, but the structure regarding the rear first and second projection stripes $\mathbf{24}_F$ and $\mathbf{25}_F$ is substantially the same as the structure regarding the front projection stripes $\mathbf{24}_F$ and $\mathbf{25}_F$ and therefore, the duplicated description thereof is omitted.

When the folding plate blank 21 is folded in the zigzag fashion to produce the modules $\mathbf{2}_1$ of the heat exchanger 2, the first and second heat-transfer plates S1 and S2 are disposed radiately from the center of the heat exchanger 2. Therefore, the distance between the adjacent first and second heat-transfer plates S1 and S2 assumes the maximum in the radially outer peripheral portion which is in contact with the outer casing 6, and the minimum in the radially inner peripheral portion which is in contact with the inner casing 7. For this reason, the heights of the first projections 22, the second projections 23, the first projection stripes $\mathbf{24}_F$, $\mathbf{24}_R$ and the second projection stripes $\mathbf{25}_F$, $\mathbf{25}_R$ are gradually increased outwards from the radially inner side, whereby the first and second heat-transfer plates S1 and S2 can be disposed exactly radiately (see FIGS. 5 and 6).

By employing the above-described structure of the radiately folded plates, the outer casing 6 and the inner casing 7 can be positioned concentrically, and the axial symmetry of the heat exchanger 2 can be maintained accurately.

By forming the heat exchanger 2 by a combination of the four modules 21 having the same structure, the manufacture of the heat exchanger can be facilitated, and the structure of the heat exchanger can be simplified. In addition, by folding the folding plate blank 21 radiately and in the zigzag fashion to continuously form the first and second heat-transfer plates S1 and S2, the number of parts and the number of brazing points can remarkably be decreased, and moreover, the dimensional accuracy of a completed article can be enhanced, as compared with a case where a large number of first heat-transfer plates S1 independent from one another and a large number of second heat-transfer plates S2 independent from one another are brazed alternately.

As can be seen from FIG. 5, when the modules $\mathbf{2}_1$ of the heat exchanger 2 are bonded to one another at the bond surfaces 3 (see FIG. 2), end edges of the first heat-transfer plates S1 folded into a J-shape beyond the crest-folding line $L_1$ and end edges of the second heat-transfer plates S2 cut rectilinearly at a location short of the crest-folding line $L_1$ are superposed on each other and brazed to each other. By employing the above-described structure, a special bonding member for bonding the adjacent modules $\mathbf{2}_1$ to each other is not required, and a special processing for changing the thickness of the folding plate blank 21 is not required. Therefore, the number of parts and the processing cost are reduced, and further an increase in heat mass in the bonded zone is avoided. Moreover, a dead space which is neither the combustion gas passages 4 nor the air passages 5 is not created and hence, the increase in flow path resistance is suppressed to the minimum, and there is not a possibility that the heat exchange efficiency may be reduced.

During operation of the gas turbine engine E, the pressure in the combustion gas passages 4 is relatively low, and the pressure in the air passages 5 is relatively high. For this reason, a flexural load is applied to the first and second heat-transfer plates S1 and S2 due to a difference between the pressures, but a sufficient rigidity capable of withstanding such load can be obtained by virtue of the first and second projections 22 and 23 which have been brought into abutment against each other and brazed with each other.

In addition, the surface areas of the first and second heat-transfer plates S1 and S2 (i.e., the surface areas of the combustion gas passages 4 and the air passages 5) are increased by virtue of the first and second projections 22 and 23. Moreover, the flows of the combustion gas and the air are agitated and hence, the heat exchange efficiency can be enhanced.

The unit amount $N_{tu}$ of heat transfer representing the amount of heat transferred between the combustion gas passages 4 and the air passages 5 is given by the following equation (1):

$$N_{tu}=(K\times A)/[C\times(dm/dt)] \quad (1)$$

In the above equation (1), K is an overall heat transfer coefficient of the first and second heat-transfer plates S1 and S2; A is an area (a heat-transfer area) of the first and second heat-transfer plates S1 and S2; C is a specific heat of a fluid; and dm/dt is a mass flow rate of the fluid flowing in the heat transfer area. Each of the heat transfer area A and the specific heat C is a constant, but each of the overall heat transfer coefficient K and the mass flow rate dm/dt is a function of pitches P (see FIG. 5) between the adjacent first projections 22 or between the adjacent second projections 23.

When the unit amount $N_{tu}$ of heat transfer is varied in the radial directions of the first and second heat-transfer plates S1 and S2, the distribution of temperature of the first and second heat-transfer plates S1 and S2 is non-uniformed radially, resulting in a reduced heat exchange efficiency, and moreover, the first and second heat-transfer plates S1 and S2 are non-uniformly, thermally expanded radially to generate undesirable thermal stress. Therefore, if the pitch P of radial arrangement of the first and second projections 22 and 23 is set suitably, so that the unit amount $N_{tu}$ of heat transfer is constant in radially various sites of the first and second heat-transfer plates S1 and S2, the above problems can be overcome.

Figure 10A:
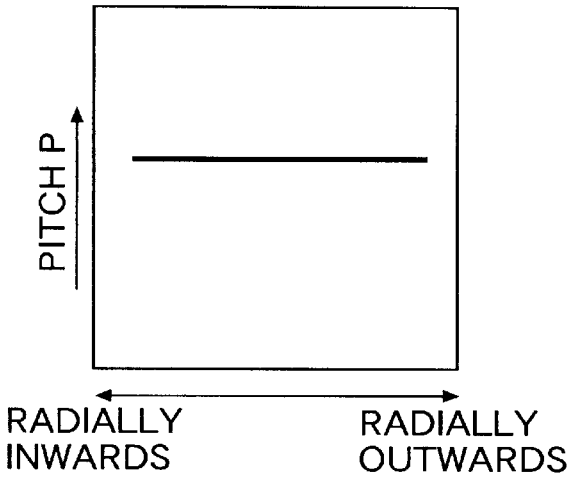
FIGS. 10A to 10C are graphs for explaining the operation when the pitch between projections is uniformized.
Figure 10B:
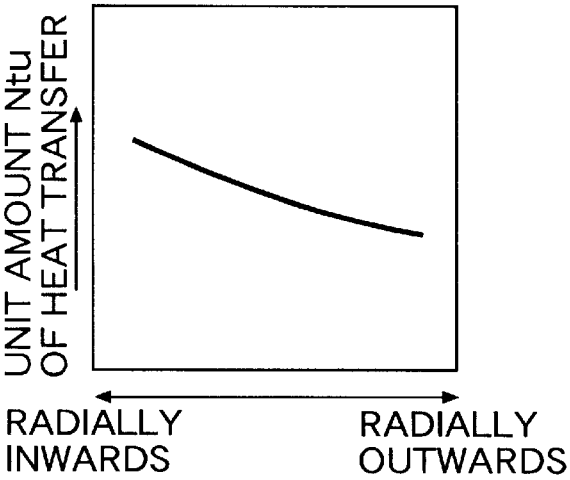
Figure 10C:
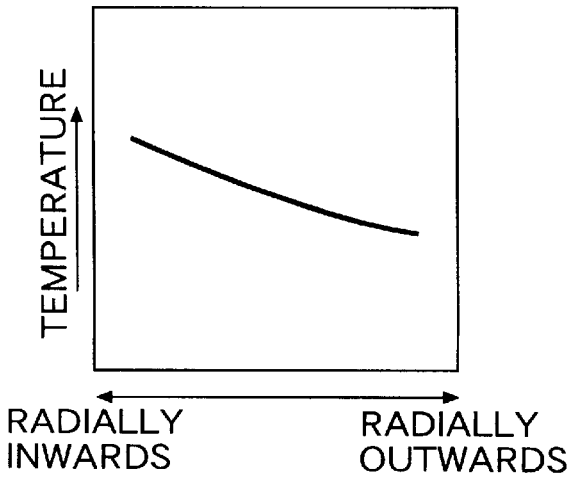
Figure 11A:
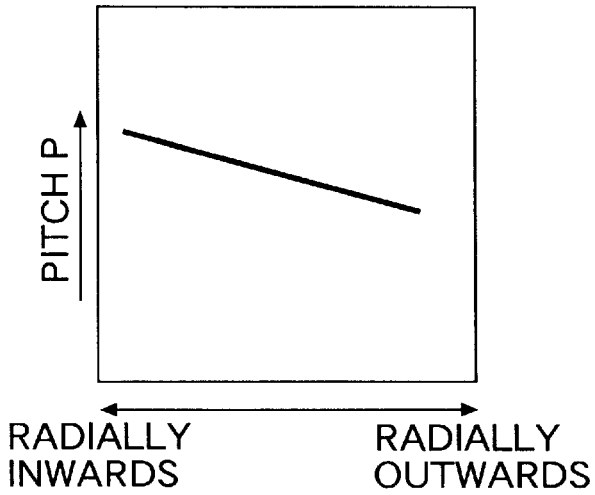
FIGS. 11A to 11C are graphs for explaining the operation when the pitch between projections is non-uniformized.
Figure 11B:
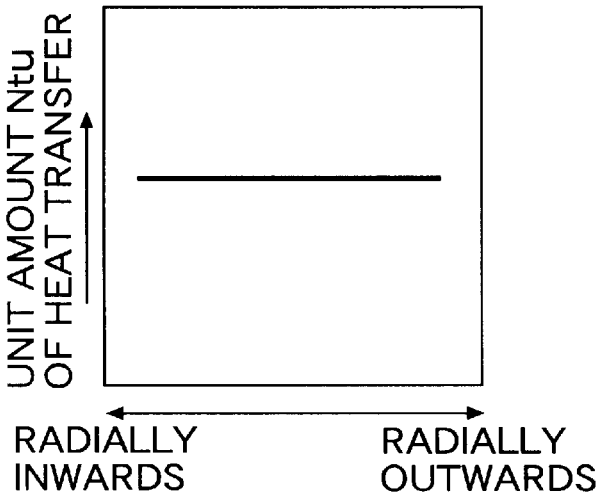
Figure 11C:
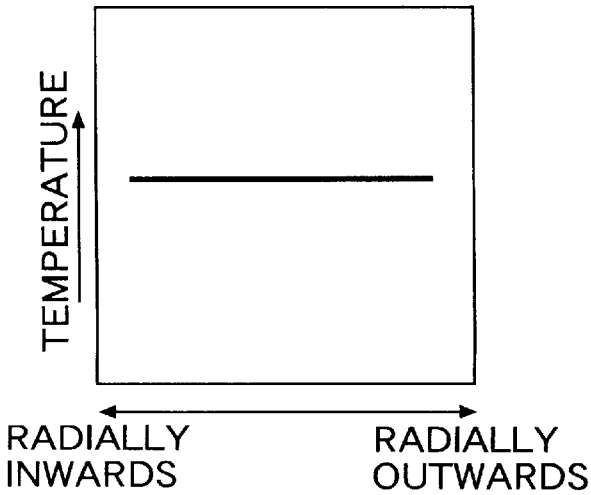

When the pitch P is set constant in the radial directions of the heat exchanger 2, as shown in FIG. 10A, the unit amount $N_{tu}$ of heat transfer is larger at the radially inner portion and smaller at the radially outer portion, as shown in FIG. 10B. Therefore, the distribution of temperature of the first and second heat-transfer plates S1 and S2 is also higher at the radially inner portion and lower at the radially outer portion, as shown in FIG. 10C. On the other hand, if the pitch P is set so that it is larger in the radially inner portion of the heat exchanger 2 and smaller in the radially outer portion of the heat exchanger 2, as shown in FIG. 11A, the unit amount $N_{tu}$ of heat transfer and the distribution of temperature can be made substantially constant in the radial directions, as shown in FIGS. 11B and 11C.

As can be seen from FIGS. 3 to 5, in the heat exchanger 2 according to this embodiment, a region having a larger pitch P of radial arrangement of the first and second projections 22 and 23 is provided in the radially inner portion of the heat exchanger 2, and a region having a smaller pitch P of radial arrangement of the first and second projections 22 and 23 is provided in the radially outer portion of the heat exchanger 2. Thus, the unit amount $N_{tu}$ of heat transfer can be made substantially constant over the entire region of the first and second heat-transfer plates S1 and S2, and it is possible to enhance the heat exchange efficiency and to alleviate the thermal stress.

If the entire shape of the heat exchanger and the shapes of the first and second projections 22 and 23 are varied, the overall heat transfer coefficient K and the mass flow rate dm/dt are also varied and hence, the suitable arrangement of pitches P is also different from that in the present embodiment. Therefore, in addition to a case where the pitch P is gradually decreased radially outwards as in the present embodiment, the pitch P may be gradually increased radially outwards in some cases. However, if the arrangement of pitches P is determined such that the above-described equation (1) is established, the operational effect can be obtained irrespective of the entire shape of the heat exchanger and the shapes of the first and second projections 22 and 23.

As can be seen from FIGS. 3 and 4, the first and second heat-transfer plates Sl and S2 are cut into an unequal-length angle shape having a long side and a short side at the front and rear ends of the heat exchanger 2. The combustion gas passage inlet 11 and the combustion gas passage outlet 12 are defined along the long sides at the front and rear ends, respectively, and the air passage inlet 15 and the air passage outlet 16 are defined along the short sides at the rear and front ends, respectively.

In this way, the combustion gas passage inlet 11 and the air passage outlet 16 are defined respectively along the two sides of the angle shape at the front end of the heat exchanger 2, and the combustion gas passage outlet 12 and the air passage inlet 15 are defined respectively along the two sides of the angle shape at the rear end of the heat exchanger 2. Therefore, larger sectional areas of the flow paths in the inlets 11, 15 and the outlets 12, 16 can be ensured to suppress the pressure loss to the minimum, as compared with a case where the inlets 11, 15 and the outlets 12, 16 are defined without cutting of the front and rear ends of the heat exchanger 2 into the angle shape. Moreover, since the inlets 11, 15 and the outlets 12, 16 are defined along the two sides of the angle shape, not only the flow paths for the combustion gas and the air flowing out of and into the combustion gas passages 4 and the air passages 5 can be smoothened to further reduce the pressure loss, but also the ducts connected to the inlets 11, 15 and the outlets 12, 16 can be disposed in the axial direction without sharp bending of the flow paths, whereby the radially dimension of the heat exchanger 2 can be reduced.

As compared with the volume flow rate of the air passed through the air passage inlet 15 and the air passage outlet 16, the volume flow rate of the combustion gas, which has been produced by burning a fuel-air mixture resulting from mixing of fuel into the air and expanded in the turbine into a dropped pressure, is larger. In the present embodiment, the unequal-length angle shape is such that the lengths of the air passage inlet 15 and the air passage outlet 16, through which the air is passed at the small volume flow rate, are short, and the lengths of the combustion gas passage inlet 11 and the combustion gas passage outlet 12, through which the combustion gas is passed at the large volume flow rate, are long. Thus, it is possible to relatively reduce the flow rate of the combustion gas to more effectively avoid the generation of a pressure loss.

Yet further, since the end plates 8 and 10 are brazed to the tip end surfaces of the front and rear ends of the heat exchanger 2 formed into the angle shape, the brazing area can be minimized to reduce the possibility of leakage of the combustion gas and the air due to a brazing failure. Moreover, the inlets 11, 15 and the outlets 12, 16 can simply and reliably be partitioned, while suppressing the decrease in opening areas of the inlets 11, 15 and the outlets 12, 16.

Although the embodiment of the present invention has been described in detail, it will be understood that the present invention is not limited to the above-described embodiment, and various modifications may be made without departing from the spirit and scope of the invention defined in claims.

For example, the heat exchanger 2 for the gas turbine engine E has been illustrated in the embodiment, but the present invention can be applied to heat exchangers for other applications. In addition, the inventions defined in claims 5 to 9 are not limited to the heat exchanger 2 including the first and second heat-transfer plates S1 and S2 disposed radiately, and are applicable to a heat exchanger including the first and second heat-transfer plates S1 and S2 disposed in parallel to one another.

What is claimed is:

1. A heat exchanger comprising axially extending high-temperature fluid passages and low-temperature fluid passages defined alternately in a circumferential direction in an annular space that is defined between a radially outer peripheral wall and a radially inner peripheral wall, said heat exchanger being formed from a folding plate blank comprising a plurality of first heat-transfer plates and a plurality of second heat-transfer plates which are alternately connected together through folding lines, said folding plate blank being folded in a zigzag fashion along said folding lines, so that said first and second heat-transfer plates are disposed radiately between said radially outer peripheral wall and said radially inner peripheral wall, whereby said high-temperature and low-temperature fluid passages are defined alternately in the circumferential direction between adjacent ones of said first and second heat-transfer plates, and a high-temperature fluid passage inlet and a low-temperature fluid-passage outlet are defined to open into axially opposite ends of said high-temperature fluid passage while a low-temperature fluid passage inlet and a low-temperature fluid passage outlet are defined to open into axially opposite ends of said low-temperature fluid passage, each of said first and second heat-transfer plates having a large number of projections formed on opposite surfaces of the plate and bonded together at tip ends of the projections, wherein pitches of said projections are set, so that a unit amount of heat transfer is substantially constant in the radial direction, and wherein said pitches gradually decrease from a radially inner side toward a radially outer side.

2. A heat exchanger according to claim 1, wherein a height of each of said projections is gradually increased from a radially inner side toward a radially outer side.

3. A heat exchanger comprising axially extending high-temperature fluid passages and low-temperature fluid passages defined alternately in a circumferential direction in an annular space that is defined between a radially outer peripheral wall and a radially inner peripheral wall, said heat exchanger being formed from a folding plate blank comprising a plurality of first heat-transfer plates and a plurality of second heat-transfer plates which are alternately connected together through folding lines, said folding plate blank being folded in a zigzag fashion along said folding lines, so that said first and second heat-transfer plates are disposed radiately between said radially outer peripheral wall and said radially inner peripheral wall, whereby said high-temperature and low-temperature fluid passages are defined alternately in the circumferential direction between adjacent ones of said first and second heat-transfer plates, and a high-temperature fluid passage inlet and a low-temperature fluid-passage outlet are defined to open into axially opposite ends of said high-temperature fluid passage while a low-temperature fluid passage inlet and a low-temperature fluid passage outlet are defined to open into axially opposite ends of said low-temperature fluid passage, each of said first and second heat-transfer plates having a large number of projections formed on opposite surfaces of the plate and bonded together at tip ends of the projections, wherein pitches of said projections are set, so that a unit amount of heat transfer is substantially constant in the radial direction, and wherein said pitches are gradually increased from a radially inner side toward a radially outer side.

4. A heat exchanger formed from a folding plate blank comprising a plurality of first heat-transfer plates and a plurality of second heat-transfer plates which are alternately connected together through first and second folding lines, said folding plate blank being folded in a zigzag fashion along said first and second folding lines, so that a gap between adjacent one of said first folding lines is closed by bonding said first folding lines and a first end plate to each other, while a gap between adjacent ones of said second folding lines is closed by bonding said second folding lines and a second end plate to each other, whereby high-temperature and low-temperature fluid passages are defined alternately between adjacent ones of said first and second heat-transfer plates, and in which opposite ends of each of said first and second heat-transfer plates in a flowing direction are cut into angle shapes each having two end edges, and a high-temperature fluid passage inlet is defined by closing one of said two end edges and opening the other end edge at one end of said high-temperature fluid passage in the flowing direction by brazing of projection stripes provided on said first and second heat-transfer plates to one another, while a high-temperature fluid passage outlet is defined by closing one of said two end edges and opening the other end edge at the other end of the high-temperature fluid passage in the flowing direction by brazing of projection stripes provided on said first and second heat-transfer plates to one another, and further, a low-temperature fluid passage inlet is defined by opening one of said two end edges and closing the other end edge at the other end of the low-temperature fluid passage in the flowing direction by brazing of projection stripes provided on said first and second heat-transfer plates to one another, while a low-temperature fluid passage outlet is defined by opening one of said two end edges and closing the other end edge at one end of the low-temperature fluid passage in the flowing direction by brazing of projection stripes provided on said first and second heat-transfer plates to one another, characterized in that the end edges of said angle shapes have extensions extending outside the projection stripes, said extensions each having projections formed thereon to protrude in a direction opposite from the projection stripes, tip ends of said projections being in abutment against one another.

5. A heat exchanger according to claim 4, characterized in that projections are formed to protrude along the inside of said projection stripes in a direction opposite from the projection stripes with tip ends of said projections being in abutment against one another.

6. A heat exchanger formed from a folding plate blank comprising a plurality of first heat-transfer plates and a plurality of second heat-transfer plates which are alternately connected together through first and second folding lines, said folding plate blank being folded in a zigzag fashion along said first and second folding lines, so that a gap between adjacent ones of said first folding lines is closed by bonding said first folding lines and a first end plate to each other, while a gap between adjacent ones of said second folding lines is closed by bonding said second folding lines and a second end plate to each other, whereby high-temperature and low-temperature fluid passages are defined alternately in the circumferential direction between adjacent ones of said first and second heat-transfer plates, and in which opposite ends of each of said first and second heat-transfer plates in a flowing direction are cut into angle shapes each having two end edges, and a high-temperature fluid passage inlet is defined by closing one of said two end edges and opening the other end edge at one end of said high-temperature fluid passage in the flowing direction by projection stripes provided on said first and second heat-transfer plates, while a high-temperature fluid passage outlet is defined by closing one of said two end edges and opening the other end edge at the other end of said high-temperature fluid passage in the flowing direction by projection stripes provided on said first and second heat-transfer plates, and further, a low-temperature fluid passage inlet is defined by opening one of said two end edges and closing the other end edge at the other end of said low-temperature fluid passage in the flowing direction by projection stripes provided on said first and second heat-transfer plates, while a low-temperature fluid passage outlet is defined by opening one of said two end edges and closing the other end edge at one end of said low-temperature fluid passage in the flowing direction by projection stripes provided on said first and second heat-transfer plates, wherein a gap is defined between tip ends of projection stripes opposed to each other and forming a pair on opposite sides of each of said folding lines, and said folding line is dispose within said gap, and wherein a circumferential length of a folded area at each of said folding lines is set equal to a width of said gap.

7. A heat exchanger according to claim 6, characterized in that said projection stripes are formed so as not to interfere with a folding area at each of said folding line.

8. A heat exchanger according to claim 3, wherein a height of each of said projections is gradually increased from a radially inner side toward a radially outer side.

* * * * *